US009134061B2

(12) United States Patent
Bowdish et al.

(10) Patent No.: US 9,134,061 B2
(45) Date of Patent: Sep. 15, 2015

(54) FLOW CONTROL OF A CRYOGENIC ELEMENT TO REMOVE HEAT

(75) Inventors: Boyd Bowdish, Los Gatos, CA (US); William Moon, Provo, UT (US)

(73) Assignee: REFLECT SCIENTIFIC INC., Orem, UT (US)

( * ) Notice: Subject to any disclaimer, the term of this patent is extended or adjusted under 35 U.S.C. 154(b) by 566 days.

(21) Appl. No.: 13/357,617

(22) Filed: Jan. 25, 2012

(65) Prior Publication Data

US 2012/0174600 A1 Jul. 12, 2012

Related U.S. Application Data

(63) Continuation-in-part of application No. 12/185,681, filed on Aug. 4, 2008, now abandoned.

(51) Int. Cl.

| | |
|---|---|
| ***F17C 9/02*** | (2006.01) |
| ***F17C 9/04*** | (2006.01) |
| ***F17C 7/02*** | (2006.01) |
| ***F17C 7/04*** | (2006.01) |
| ***F25D 3/10*** | (2006.01) |
| ***F25B 9/00*** | (2006.01) |
| *F25B 39/02* | (2006.01) |
| *F25D 29/00* | (2006.01) |

(52) U.S. Cl.

CPC ... *F25D 3/10* (2013.01); *F25B 9/00* (2013.01); *F25B 39/028* (2013.01); *F25D 29/001* (2013.01)

(58) Field of Classification Search

CPC ..... F17C 9/02; F17C 9/04; F17C 7/02; F25B 29/001; F25B 17/06

USPC ..... 62/50.1, 50.2, 50.7, 390, 910, 50.3, 62/47.1, 48.1, 53.2

See application file for complete search history.

(56) References Cited

U.S. PATENT DOCUMENTS

| | | | | | |
|---|---|---|---|---|---|
| 3,152,452 | A | * | 10/1964 | Bond, Jr. et al. | 62/50.7 |
| 3,406,533 | A | * | 10/1968 | Watkins | 62/217 |
| 4,100,759 | A | * | 7/1978 | Tyree, Jr. | 62/50.1 |
| 5,054,292 | A | * | 10/1991 | Klee | 62/63 |
| 5,265,430 | A | * | 11/1993 | Chen et al. | 62/48.1 |
| 5,313,787 | A | * | 5/1994 | Martin | 62/222 |
| 5,335,503 | A | * | 8/1994 | Lee | 62/50.1 |
| 5,394,704 | A | * | 3/1995 | Johnson | 62/51.1 |
| 5,660,046 | A | * | 8/1997 | de Langavant et al. | 62/50.3 |
| 6,640,555 | B2 | * | 11/2003 | Cashin | 62/50.2 |
| 7,219,449 | B1 | * | 5/2007 | Hoffberg et al. | 36/88 |
| 8,113,006 | B2 | * | 2/2012 | Rech et al. | 62/50.3 |
| 2002/0023447 | A1 | * | 2/2002 | Podtchereniaev et al. | 62/217 |
| 2007/0144191 | A1 | * | 6/2007 | Viegas et al. | 62/185 |
| 2009/0019869 | A1 | * | 1/2009 | Girard et al. | 62/168 |

* cited by examiner

*Primary Examiner* — Mohammad M Ali
*Assistant Examiner* — Meraj A Shaikh
(74) *Attorney, Agent, or Firm* — Tran & Associates

(57) ABSTRACT

A system provides the flow control of a cryogenic element to remove heat from an environment. The system includes a cryogenic storage to store a cryogen; a cryogenic delivery system coupled to the cryogenic storage to transport the cryogen; a distributor coupled to the cryogenic delivery system, the distributor having a plurality of distribution lead tubes to evenly distribute the enthalpic potential of the cryogenic element; and a heat exchanger coupled to the distribution lead tubes.

25 Claims, 8 Drawing Sheets

| |
|---|
| Determine orifice size to maximum needed energy extraction for the cryogenic cooling process air cooling needed (1002) |
| Select control valve (1006) |
| Determine size of the cryogenic air coil as a function of the air flow needed to move the air through the volume of the refrigerated space (1008) |
| Determine size of the fan system (1010) |
| Determine system's total size and foot print dominations (1012) |
| Place control sensors at the inlet and the outlet of the cryogenic air coil to collect an average temperature for maximum thermal efficacy usage of the cryogen (1014) |

FIG. 6

FLOW CONTROL OF A CRYOGENIC ELEMENT TO REMOVE HEAT

This application is a continuation-in-part of U.S. application Ser. No. 12/185,681, filed Aug. 4, 2008, now abandoned the content of which is incorporated by reference.

FIELD OF THE INVENTION

The present invention relates to the removal of heat from an environment by the flow control of cryogenic elements through a heat exchanger, thus controlling the enthalpic potential of said cryogenic elements.

BACKGROUND OF THE INVENTION

Due to an increasing demand for technology that is both electrically efficient and environmentally responsible, there exists a need to develop technologies that address the cooling of environments such as Data Centers or other IT operations, thermal stress test chamber, or a Logistical Delivery Transport truck. In refrigerated trucks or trailers which commonly transport sensitive food products, refrigeration failure can be costly in terms of food spoilage and business disruption. Excursions in temperature or outright failure may be catastrophic in the biomedical field. For example, the destruction of a limited supply of special vaccine, stored under very low temperature for emergency protection of the general public, is highly undesirable.

Similarly, in the telecommunications, information storage and exchange industries i.e. Data Centers, there is an increasing need for reliable cooling of racks of servers in these environments. A failure of the cooling equipment can lead to failures in the servers, which can mean downtime for mission critical software and hardware failure for customer web application software. In the electronics stress testing field, reliable environmental simulation chambers need to achieve very low temperatures to properly test their loads/products. Additionally, back up cooling systems may be needed to supplement existing conventional cooling systems. These chambers may need to support a temperature range from room temperature (25 degrees C.) down to a cryogenic temperature as low as −150 degrees C.

Given all of these technological requirements and specifications, there has been the introduction of the requirement to be environmentally responsible with the use of electrical power and to reduce the carbon footprint of these operations. This need to reduce electrical power consumption in the controlling of heat in an environment and replace that consumption with a renewable resource has given way to the embodied concept of flow control of a cryogenic element for removing heat.

SUMMARY

In one aspect, a system the provides the flow control of a cryogenic element to remove heat from an environment that includes a cryogenic storage to store a cryogen; a cryogenic delivery system coupled to the cryogenic storage to transport the cryogen; a distributor coupled to the cryogenic delivery system, the distributor having a plurality of distribution lead tubes to evenly distribute the enthalpic potential of the cryogenic element; and a heat exchanger coupled to the distribution lead tubes.

Implementations of the above aspect may include one or more of the following. Fluid or air can be used as the temperature heat exchange medium. The cryogenics delivery system can be vacuum insulated (VIP) supply hoses and valves. The system can use a VIP proportional control valve set up with a redundant safety valve that closes in a fail position without requiring power. The cryogenic air heat exchanger can include one or more circuits in the air coil and can have one or more redundant air coil circuits. The cryogen is distributed evenly throughout a heat exchanger. The cryogenic delivery system can have one or more relief valves. The distributor can have a pressure drop zone to facilitate enthalpic processes. The distributor can have an outlet at one end to distribute the cryogenic element. The outlet can be cone-shaped and can include a cone inside to equalize the pressure and flow of the cryogenic element. The distributor can have one or more nozzles. A coil plate fin can be used to receive one or more coil circuits, where each coil circuit can have a coil tube. The coil plate can be a plate fin heat exchanger such as aluminum or copper, or other heat exchanger types such as a plate heat exchanger, regenerative or modified economizer heat exchanger. A reliquifier can be used at the end to reuse the cryogen. Alternatively, an exhaust capture unit can be used to recycle gas exhaust to an alternate recovery process. The cryogenic delivery system can have one or more proportional proportional-integral-derivative (PID) control valves. The distributor can have an orifice. The orifice is sized to deliver the cryogenic element with the appropriate enthalpy for the application and apply the element to the heat exchanger. The heat exchanger can have one or more cryogenic coils, where the size of the cryogenic coil is determined by the air flow needed to move air through a predetermined volume. A fan can generate air flow, wherein the size of the fan is determined based on a predetermined volume. One or more control sensors placed at an inlet and an outlet of a heat exchanger to measure an average temperature, and the output can be used by a PID controller to accurately provide control of the cryogenic element for appropriate heat transfer.

In another aspect, a system provides the flow control of a cryogenic element to remove heat from an environment. The system includes a cryogenic storage to store a cryogen; a cryogenic delivery system coupled to the cryogenic storage to transport the cryogen; a distributor coupled to the cryogenic delivery system, the distributor having a plurality of distribution lead tubes to evenly distribute the enthalpic potential of the cryogenic element; a heat exchanger coupled to the distribution lead tubes; and a controller to provide a flow control of the cryogenic element to remove heat from the environment in a closed-loop.

In another aspect, systems and methods are disclosed to provide a cryogenic air cooling system with air flow as the heat transfer medium. The system can be closed loop to avoid discharging the cryogenic elements into the controlled space.

Advantages of preferred embodiment may include one or more of the following. The system can achieve a target temperature of, or within the ranges of, +20, 0, −10 −20, −40, −60, −80, −120, −150, deg. C. and can continuously maintain that temperature accurately and reliably. The preferred embodiment provides temperature accuracy independent of ambient conditions of temperature and humidity while maintaining electrical efficiency and environmentally responsible operation through the use of a renewable resource heat exchange methodology.

The system provides cryogenic heat exchange of air using cryogenic elements. The temperature range is from +25 degrees Centigrade to −150 degrees Centigrade. The low temperature prevents raw material biodeterioration when biological materials are stored.

The system can also be used for refrigerated logistical delivery transport trailers, thermal stress testing chambers, data center rooms and Computer/IT controlled environments. Operating cost for the preferred embodiment can be lowered due to a reduction in electrical power needed to operate the conventional systems. The operating costs are lowered by the combination of the cryogenic air conditioning or refrigeration process and the use of an efficient delivery system that may include vacuum insulated piping materials.

BRIEF DESCRIPTION OF THE DRAWINGS

FIG. 6 shows an exemplary method for determining the variables of the enthalpic process such as the size of an orifice in FIG. 2.

DESCRIPTION

Figure 1A:
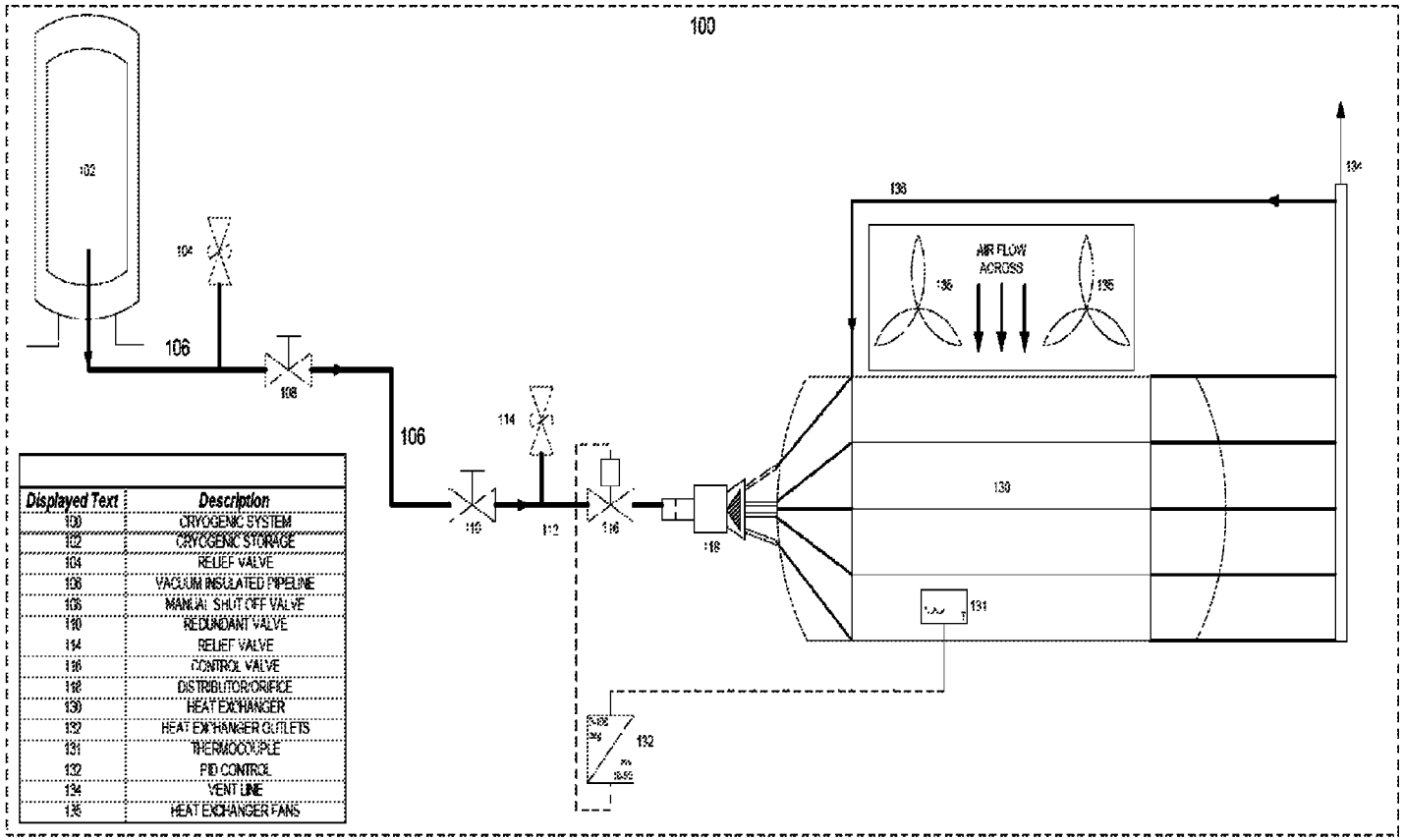
FIG. 1A shows an exemplary block diagram of a cryogenics system.

FIG. 1A shows a block diagram of an exemplary cryogenic system 100 in accordance with one aspect of the invention. In this system, cryogenic liquid or material such as liquid nitrogen (LN2) is stored in a cryogenic tank 102. The tank is connected to a supply line 106 which has a relief valve 104.

The supply line 106 can be a vacuum insulated piping (VIP) line to minimize the vaporization of the cryogens during the transfer of the cryogenic liquids due to heat gain and vaporization. With vacuum insulated piping, the vacuum insulation decreases heat gain caused from conduction, convection, or radiation.

Fittings for input and output connection to the air heat exchanger air conditioning and or refrigeration source are configured and welded or bayoneted with cryogenic connectors in place. Preferably, the connection between the vacuum insulated pipes is done with a bayonet connector that is vacuum insulated. These are standard cryogenic industry components.

A manual shut-off valve 108 is connected to the supply line 106 to allow a user to shut-off the system in case of an emergency. The LN2 liquid passes through a EMO (emergency machine off) valve 110 and enters another valved supply line 112. The supply line 112 has a relief valve 114 and is gated by a control valve 116. The LN2 liquid then travels through a distributor 118 which evenly controls the flow of the cryogenic element over a plurality of lead tubes 120.

Figure 1B:
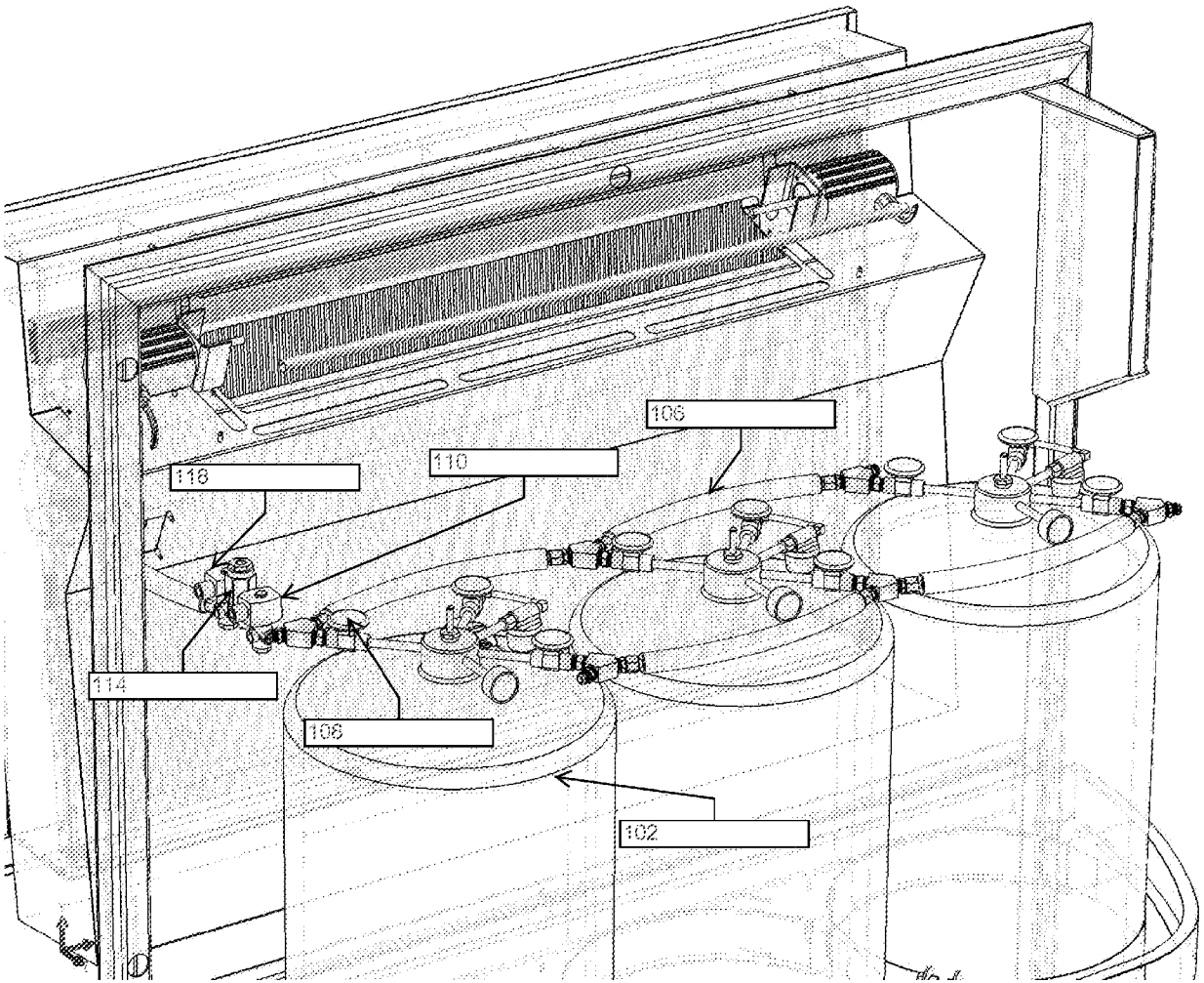
FIGS. 1B-1C shows side views of one embodiment of the invention.
Figure 1C:
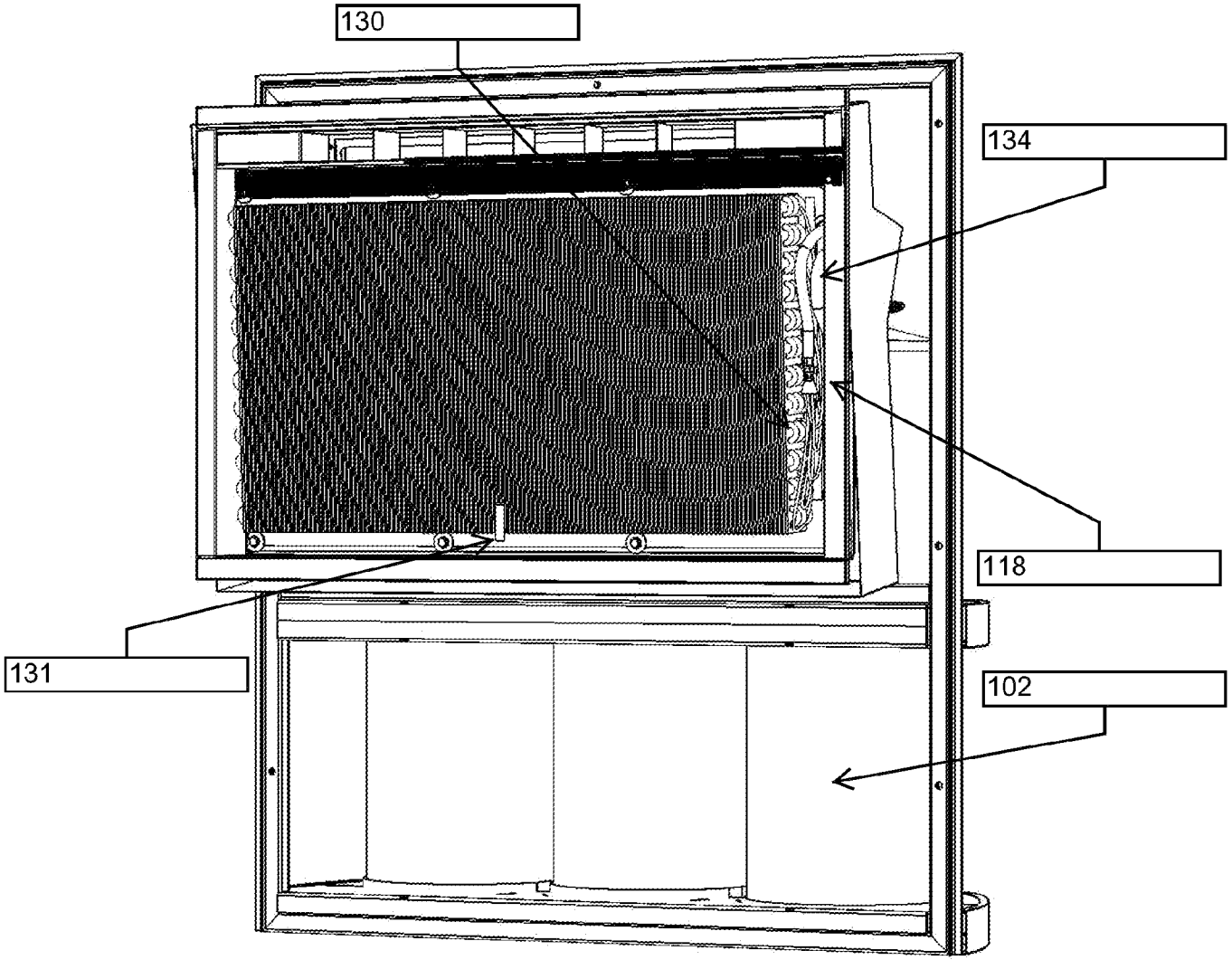

The amount of cryogen flow is determined by thermocouple 131 and PID control 132, which contains an algorithm that determines the enthalpy requirement as shown in FIG. 1C.

The lead tubes 120 exit the heat exchanger 130 at a distributed outlet 132. In one embodiment, a portion of the exhausted gasses can be vented to the outside through a vent line 134, and the majority is recalculated and reused through a reuse outlet 136 and valve 137. The exhaust gas can be used for a different process such as a controlled atmosphere with an inert gas to reduce the water vapor content of the payload bay area, reducing the enthalpy requirements of the payload bay. Bio-Deterioration within the payload bay or chamber may also be reduced through the reduction of $CO^2$ within the source environment.

FIGS. 1B-1C shows various views of one embodiment of the invention. In FIG. 1C, the assembly is mounted in a frame wherein the sub-components are installed. The heat exchanger 130 is positioned at a 15° angle to the incoming air stream. The liquid path from the storage tanks 102 to the heat exchanger 130 is provided through piping 106, valves 108, 110 and to control valve 118. Exhaust gas is plumbed through pipe 134.

The control network starts at thermocouple 131 which monitors the temperature of the supply air to the heat exchanger 130. This data is fed to the PID control 132 which compares several factors, outputting a percentage open for control valve 118. Factors such as the desired payload temperature, incoming liquid temperature, supply air temperature and exhaust gas temperature.

Figure 2:
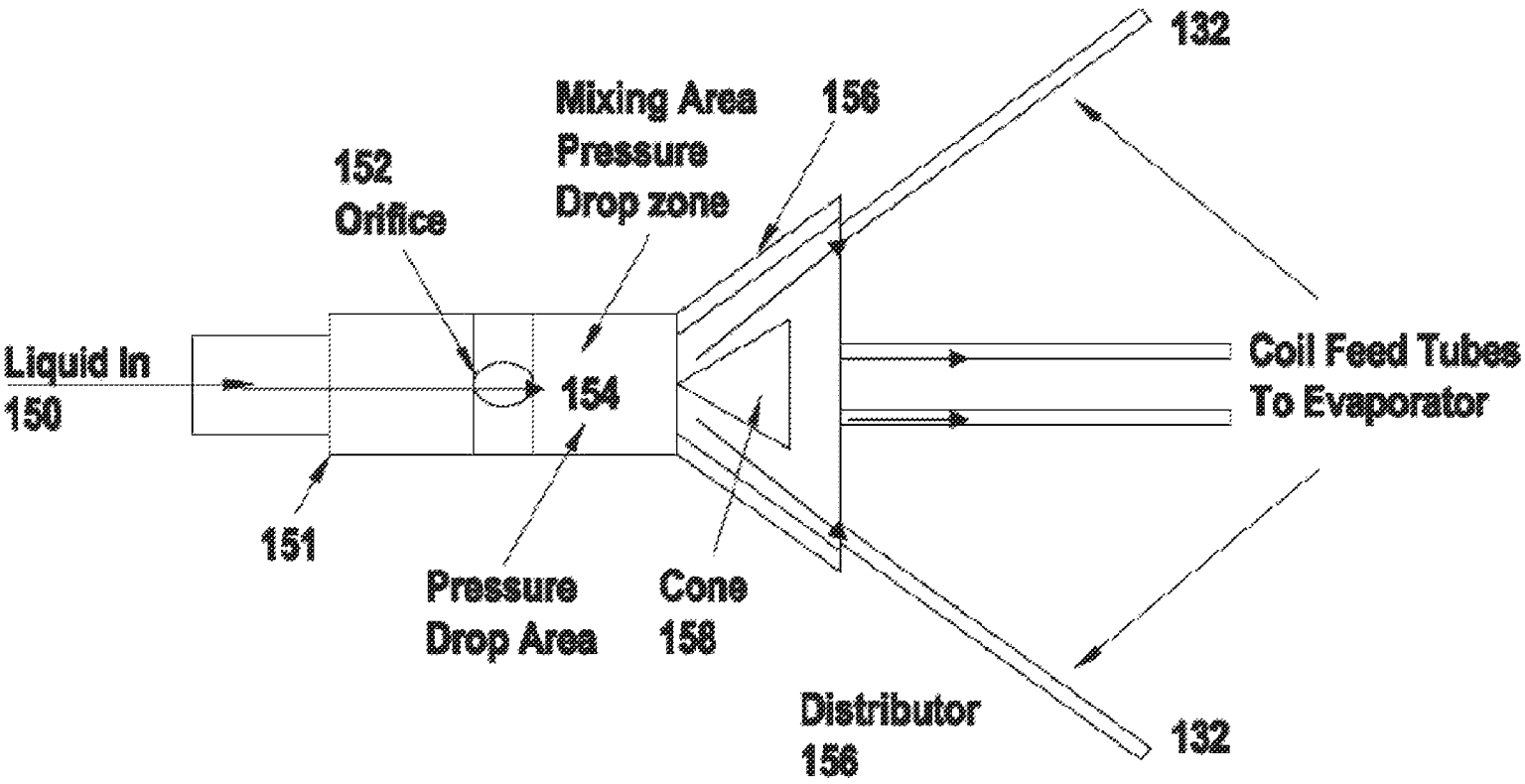
FIG. 2 shows in more details an exemplary cryogenic distribution system.

FIG. 2 shows in more detail an exemplary flow control of a cryogenic element system. A cryogenic element is delivered to an input 150 of a chamber 151. An orifice 152 receives the cryogen into one end (such as inlet) of the chamber 151. A distributor 156 is connected to the other end [outlet] of the chamber 151. The distributor 156 is larger in volume then the upstream chamber and will be at a lower potential pressure than the pressure at the orifice 152 and thus the chamber 151 has a pressure drop area 154. A cone 158 is provided at the junction between the chamber 151 and the distributor 156. The cone 158 is designed and positioned in such a way as to provide an equalization of pressure between area 154 and the evaporator. This controlled flow of the cryogenic element is then plumbed to a plurality of coil feed tubes 132 that deliver the cryogenic element to the evaporator 130.

Figure 3:
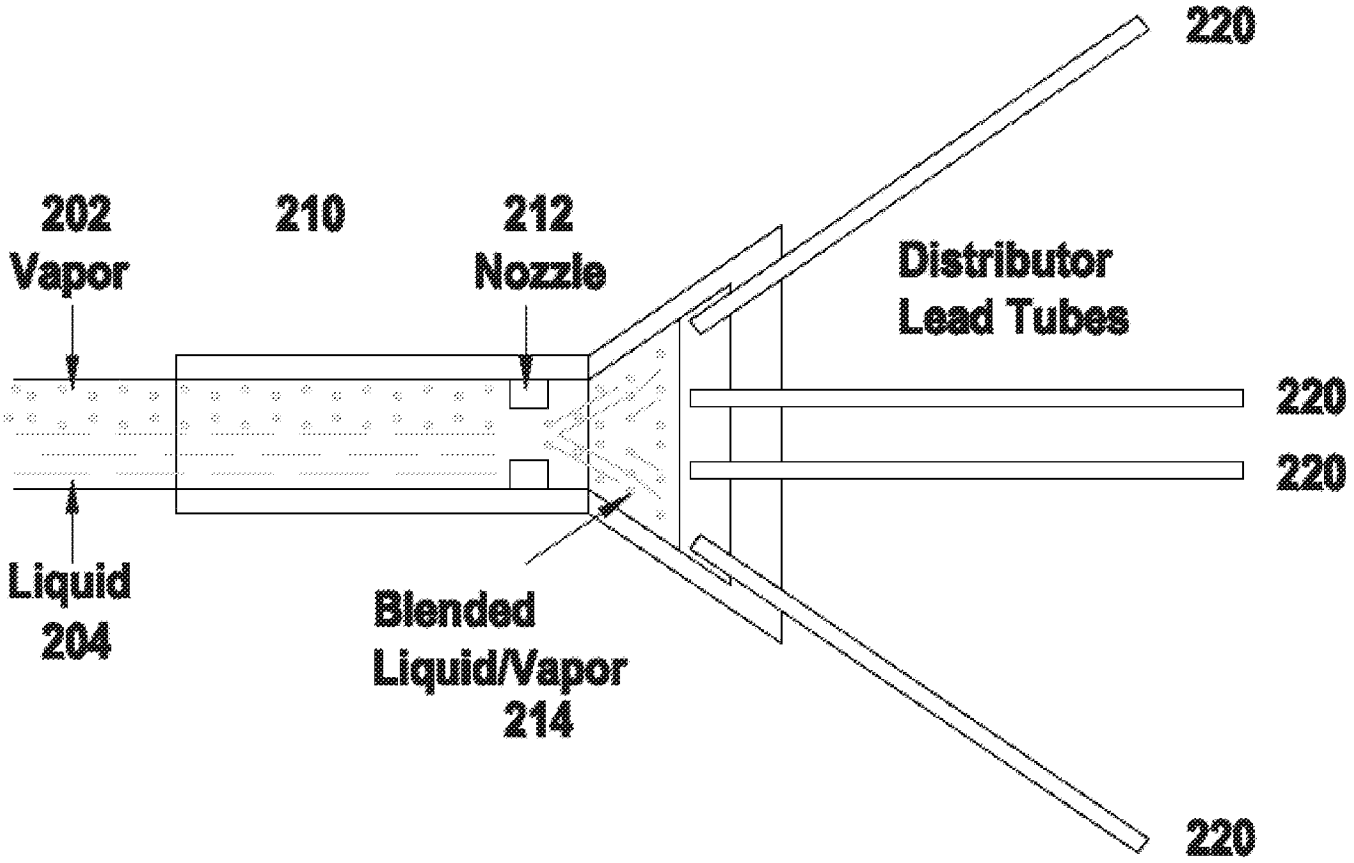
FIG. 3 shows another exemplary cryogenic distribution system.

FIG. 3 shows another exemplary system for the control of a cryogenic element where vapor 202 and liquid nitrogen 204 (cryogenic element) are provided to a chamber 210. Nozzles 212 on the chamber 210 are design and positioned in such a manner as to provide an pressure drop across nozzles 212, and it is this controlled flow of the cryogenic element 214 that is then plumbed to a plurality of distributor lead tubes 220.

Preferably, the distribution of the cryogenic element is constant in flow and pressure though out the air coil and/or refrigerant heat exchanger coil or high reliability multi-tube thermal exchange structure as disclosed in U.S. Pat. No. 6,804,976 (the content of which is incorporated by reference), thus maintaining the enthalpy, kinetic potential, of the cryogenic element and the heat exchanger. The manipulation of the various parts of the system, thus controlling the enthalpy, is accomplished using the feedback control described within. The control of the cryogenic element via the comparative function of temperature of the heat exchanger and incoming load constitutes the flow control of a cryogenic element for removing heat. Changing any/all of the various parts of the system, either in real time or via manufacturing change, denotes a recalculation of the enthalpy of the system, thus adjusting for constant change in source heat load or application changes from site to site.

Figure 4:
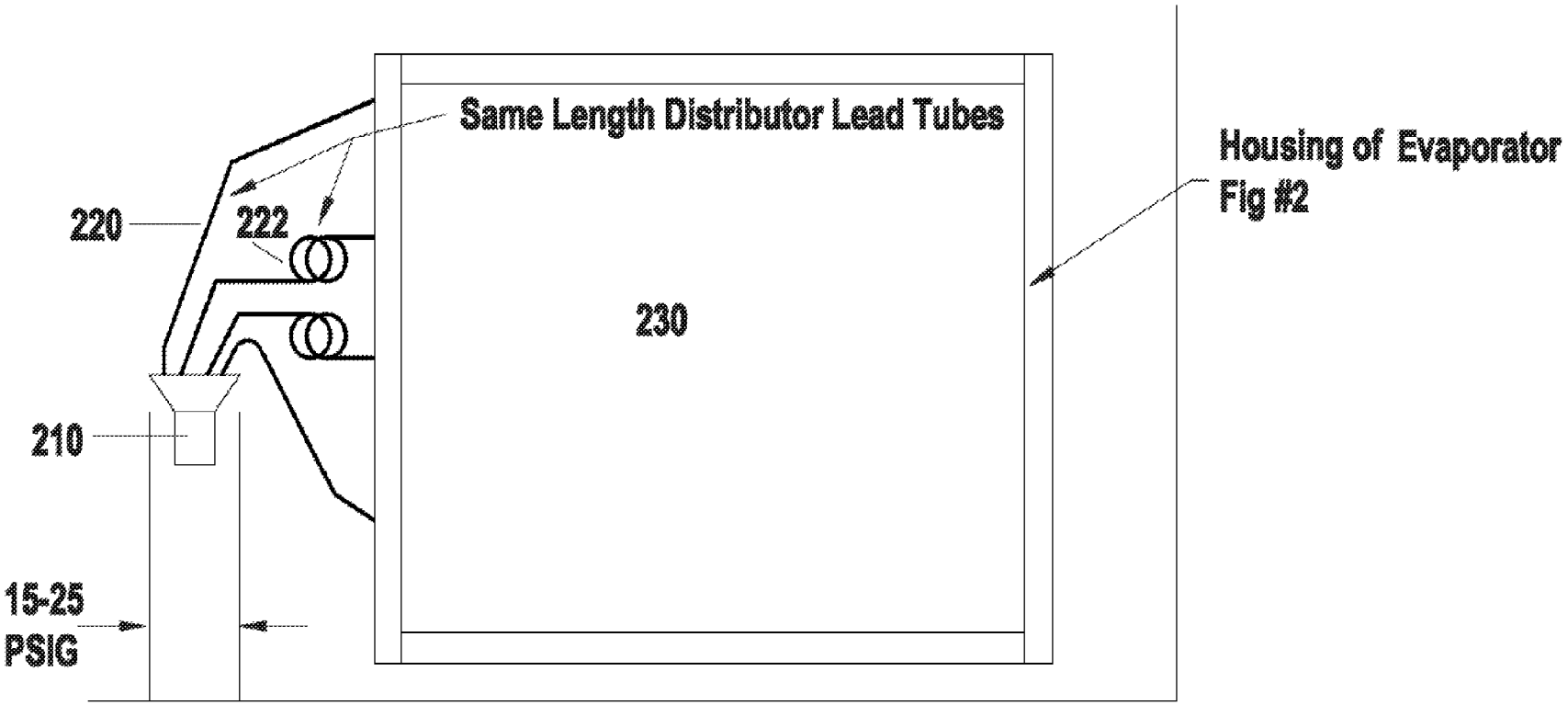
FIG. 4 shows a cryogenic system with a plurality of distributor lead tubes that deliver a cryogenic element at equal flow and pressure.

FIG. 4 shows a cryogenic system with a plurality of equal length distributor lead tubes that are equal in delivery pressure through proportionatly equal bends and/or tube inner diameters This equalization facilitates the proficient thermodynamic control of the cryogenic element into the heat exchanger. As shown in FIG. 4, the chamber 210 provides distributor lead tubes 220 and 222 that have the same length and are of the same diameter. To connect the points that are close to the chamber 210, the distributor lead tube is coiled so that the cryogenic element which is delivered over coil 222 to an evaporator housing 230 has the same flow, pressure and enthalpy. It can also be said that tubing of different diameters can be used to control the enthalpy of the cryogenic element. It is the control of the thermodynamic potential that is maintained during the transport of the cryogenic element to the heat exchanger.

Figure 5:
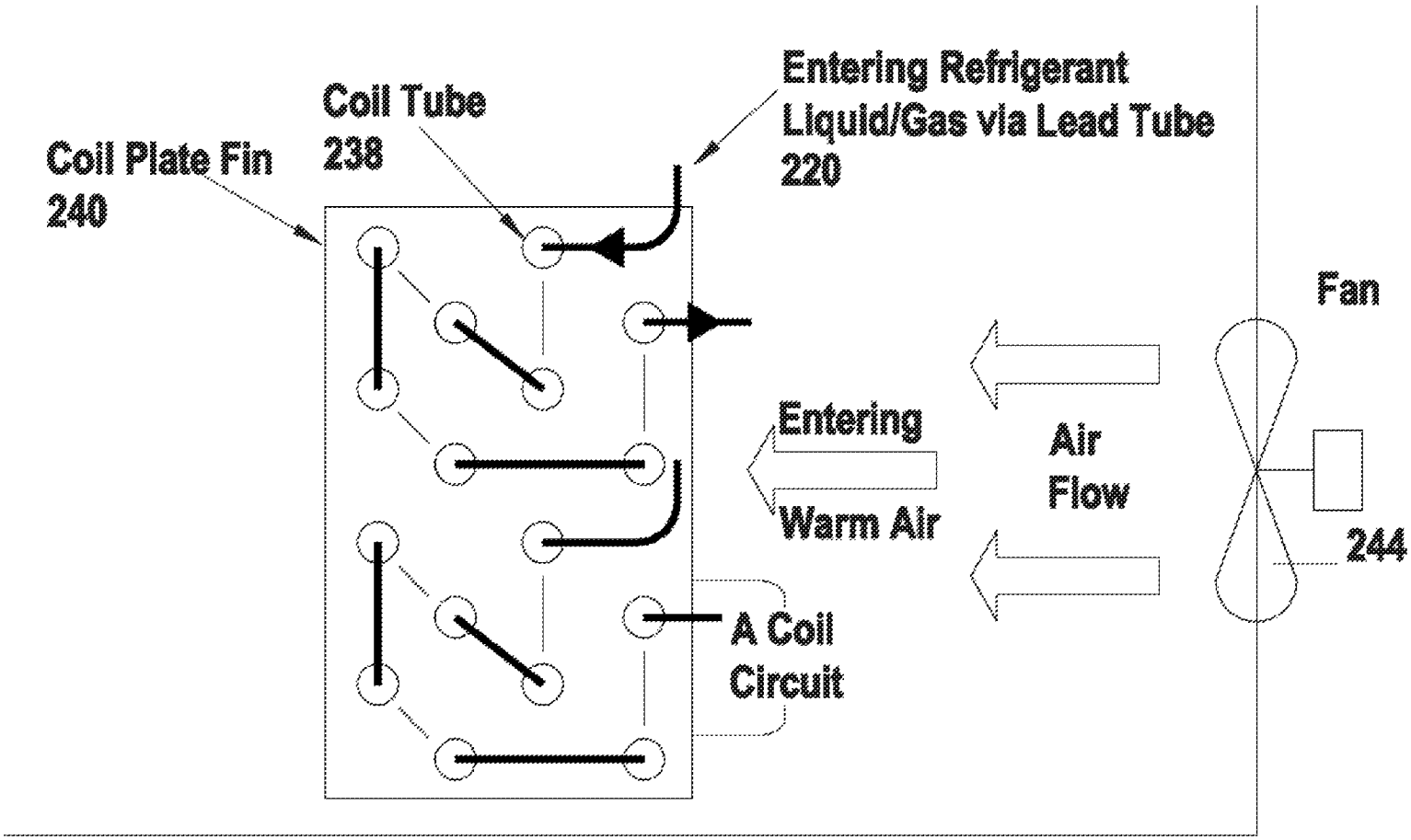
FIG. 5 shows an exemplary evaporator system.

FIG. 5 shows an exemplary evaporator system using a cryogenic element 214 delivered using the distributor lead tube 220. The process of applying the systems thermodynamic potential takes place in an evaporator 230, which is implemented, in one embodiment, as tubing built into the walls of a coil plate fin 240. A cryogenic element entering the evaporator in a cryogenic liquid state at the end of the tubing vaporizes, thus changing from liquid to gas. This entropic process removes heat that is present at the front face of the evaporator. The gas is drawn out from the opposite end of the tubing, recompressed and condensed back to liquid state in a continuous loop process. The heat source flow is driven by a fan 244 which circulates warm air 248 over the coil tube 238 to remove the desired BTU's from the source heat load.

The lead tube 220 is connected to a coil tube 238 which supports a coil circuit 242 to maximally expose the coil tube 238 to the heat source annotated as arrows 248. Preferably, the cryogenic heat exchanger has one or more circuits 242 in the air coil 238 including redundant circuits. The redundant circuits allow reliable operation in case the other circuit(s) fails.

In one embodiment, the tubing fittings for input and output connection to air heat exchanger coil tube 238 are configured and welded or bayoneted with cryogenic connectors in place.

The use of a heat exchanger results in the relatively rapid warming and vaporization of the cryogenic elements. While in transit in coil tube 238, heat from the heat source 248 warms the coil tube 238 thus allowing for the transfer of energy from the heat source to the cryogenic element. Generally, the heat exchanger takes the form of heat transfer elements or sleeves which surround and closely contact the coil tubes 238 through which the cryogenic fluid is passing. These sleeves are made from a material having a relatively high thermal conductivity and typically are provided with fins or other extended surfaces in order to increase their surface area, thereby resulting in even distribution of the enthropic processes. The heat exchanger units consist of a plurality of separate sleeve sections which are arranged in a vertical parallel fashion and which are interconnected by a manifold system so that the cryogenic element passes through them in a serpentine fashion.

In one embodiment, the heat transfer sections have long, multi-finned extruded aluminum or copper sections. The heat exchangers can be plate-fin type heat exchangers. As the cryogenic element is passed through the plate fin, heat is transferred from the heat source to the cryogenic element. A vaporizer unit can have a plurality of such heat transfer sections disposed vertically and arranged in a bank. The sections were connected in series, with the output opening of one section being welded to the input opening of the next section.

The aluminum or copper cold plates and plate-fin heat exchangers are lightweight and yet provide high performance.

FIG. 6 shows an exemplary process for determining the variables required for a given application of the system. The sizing of components such as sizing of the orifice 152 of FIG. 2 is performed. First, the orifice is sized to the maximum enthalpy required (in BTU) for the enthalpic value needed (1002).

Next, the control valve is selected (1006). The control valve needs to be of the proportional control type incorporating a control component with proportional-integral-derivative (PID) functions and temperature comparative functions. (Next, the size of the heat exchanger coil is determined as a function of the heat source/enthalpy ratio. (1008).

After the coil size is determined the size of the fan system is calculated (1010). After the components have been defined, the system's total size and foot print can be determined (1012).

The flow control of the cryogenic element is performed as a function of temperature at the heat exchanger can use a PID controller for accurate temperature control. For the PID controller, control sensors are placed at the inlet and the outlet of the heat exchanger to collect an average temperature for proper application of the enthalpic potential of the cryogenic element (1014).

The temperature range is from ambient e.g +75 degrees Fahrenheit to −120 degrees Fahrenheit. This system controls the flow of a cryogenic element which in turn controls the enthalpic potential of said cryogenic element as it is applied to a heat source which can be Refrigerated Trailers, Environmental Chambers, and computer cooling rooms, among others.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An enthalpic system comprising:

a cryogenic storage to store a cryogen;

a cryogenic delivery system coupled to the cryogenic storage to transport the cryogen;

a distributor coupled to the cryogenic delivery system, the distributor having a chamber with a mixing area pressure drop zone coupled to a cone positioned between the chamber and the distributor, wherein the chamber includes nozzles before the cone to provide an equalization of pressure between the mixing area pressure drop zone and a heat exchanger wherein the cone is coupled to the distributor and a plurality of distribution tubes to receive the cone's output, where the distribution tubes are balanced for flow, pressure, temperature and enthalpy; and the heat exchanger coupled to the distribution tube, where the heat exchanger is an evaporator, the heat exchanger removing heat from an environment using a cryogenic element controlled by a processor executing computer code to control removal of heat to reach a desired environment temperature given enthalpy in the cryogenic element including latent heat and sensible heat and an incoming source load temperature, wherein the processor controls the cryogenic element with a comparative function of temperature of a heat exchanger and incoming load in a closed loop flow control of the cryogenic element for removing heat and adjusts for constant change in source heat load or application changes.

2. The system of claim 1, comprising a temperature heat exchange medium of either fluid or air.

3. The system of claim 1, wherein the cryogenics delivery system comprises vacuum insulated supply hoses and vacuum insulated valves.

4. The system of claim 1, comprising a vacuum insulated piping (VIP) control valve set and a redundant safety valve that closes in a fault condition.

5. The system of claim 1, wherein the cryogenic heat exchanger comprises one or more coil circuits.

6. The system of claim 5, wherein the cryogenic heat exchanger comprises a redundant coil circuit.

7. The system of claim 1, wherein the cryogenic element is distributed evenly throughout a heat exchanger to provide an accurate application of the enthalpic potential of the cryogenic element.

8. The system of claim 1, wherein the cryogenic element is distributed evenly throughout a refrigerant heat exchanger coil.

9. The system of claim 1, wherein the cryogenic delivery system comprises one or more relief valves.

10. The system of claim 1, wherein the distributor comprises a pressure drop zone.

11. The system of claim 1, wherein the distributor comprises an outlet at one end to distribute the cryogenic element.

12. The system of claim 11, wherein the outlet further comprises a cone used to perform vaporized cryogen flow equalization tasks.

13. The system of claim 1, wherein the distributor comprises one or more nozzles used to perform a predetermined pressure drop.

14. The system of claim 1, comprising a coil plate fin to receive one or more coil circuits.

15. The system of claim 14, wherein each coil circuit comprises a coil tube.

16. The system of claim 1, comprising a coil plate with a plate fin heat exchanger.

17. The system of claim 16, wherein the plate-fin heat exchanger comprises aluminum or copper.

18. The system of claim 1, comprising a reliquifier to reuse the cryogenic element.

19. The system of claim 1, comprising an exhaust capture unit to recycle gas exhaust to an alternate recovery process.

20. The system of claim 1, wherein the cryogenic delivery system comprises one or more variable proportional-integral-derivative (PID) control valves.

21. The system of claim 1, wherein the distributor comprises an orifice.

22. The system of claim 21, wherein the orifice is sized to satisfy a required enthalpic potential required of the heat exchanger.

23. The system of claim 1, wherein the heat exchanger comprises one or more coils, wherein the size of the coil allows air flow for a predetermined volume.

24. The system of claim 1, comprising a fan to generate air flow, wherein the size of the fan covers a predetermined volume.

25. The system of claim 1, comprising:

one or more control sensors placed at an inlet and an outlet of a coil to measure an average temperature; and a proportional-integral-derivative (PID) controller coupled to the control sensors to accurately provide process data so that the appropriate enthalpy is applied to the source heat load.

* * * * *